US008616692B2

(12) United States Patent
Kataniwa

(10) Patent No.: US 8,616,692 B2
(45) Date of Patent: Dec. 31, 2013

(54) PRINTER

(71) Applicant: Seiko Epson Corporation, Tokyo (JP)

(72) Inventor: Yuichi Kataniwa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/858,058

(22) Filed: Apr. 7, 2013

(65) Prior Publication Data

US 2013/0222495 A1 Aug. 29, 2013

Related U.S. Application Data

(63) Continuation of application No. 13/278,586, filed on Oct. 21, 2011, now abandoned.

(30) Foreign Application Priority Data

Oct. 22, 2010 (JP) ..... 2010-237158

(51) Int. Cl.
*B41J 2/19* (2006.01)

(52) U.S. Cl.
USPC ..... 347/92

(58) Field of Classification Search
USPC ..... 347/65, 66, 67, 84, 85, 86, 87, 90, 92
See application file for complete search history.

(56) References Cited

U.S. PATENT DOCUMENTS 6,447,084 B1 * 9/2002 Uetsuki et al. ..... 347/7
6,736,496 B2 * 5/2004 Hanaoka et al. ..... 347/86
8,020,983 B2 * 9/2011 Nishimori ..... 347/92

* cited by examiner

*Primary Examiner* — Anh T. N. Vo
(74) *Attorney, Agent, or Firm* — Lowe Hauptman & Ham, LLP

(57) ABSTRACT

A printer reduces the amount of ink wastefully consumed by purging bubbles from the ink supply path. The printer has a bubble collection unit 35 that holds bubbles in the ink supply path 21 and has at least two ink paths, a first channel 26 and second channel 27, formed in the ink supply path 21 through which ink flows to the nozzles that eject ink droplets. A bubble detection unit 37 detects if the amount of bubbles in the bubble collection unit 35 has reached a specific level. A bubble discharge unit 41 discharges bubbles from the bubble collection unit 35 based on the detection result from the bubble detection unit 37. When the bubble detection unit 37 discharge bubbles from the bubble collection unit 35, ink flows through both the first path and the second path. When printing on a print medium, ink only flows through the first path.

7 Claims, 5 Drawing Sheets

PRINTER

CROSS REFERENCE TO RELATED APPLICATIONS

This application is a continuation of U.S. application Ser. No. 13/278,586, filed, Oct. 21, 2011 and is based on, and claims priority from, Japanese Application Number 2010-237158, filed Oct. 22, 2010, the disclosure of which is hereby incorporated by reference herein in its entirety.

BACKGROUND

1. Technical Field

The present invention relates to a printer that prints by ejecting ink droplets onto a print medium.

2. Related Art

Inkjet printers that print by ejecting ink droplets from a printhead having an arrangement of plural nozzles onto printing paper or other print medium are known from the literature. See, for example, Japanese Unexamined Patent Appl. Pub. JP-A-2008-87217. In order to prevent dropped dots, faint printing, and other problems caused by bubbles in the ink supply path, the inkjet printer taught in JP-A-2008-87217 has a bubble detection means that detects bubbles in the ink supply path. The bubble detection means in this inkjet printer is disposed to the joint connecting the ink supply tube and the printhead, and when the bubble detection means detects a bubble passing through the joint, ink is suctioned from the nozzles at a specified time and the bubbles are discharged from the ink supply path.

When a bubble passing the joint is detected in the inkjet printer taught in JP-A-2008-87217, ink is suctioned from the nozzles at a specified time and the ink supply path is purged of bubbles. The frequency of the ink suction operations performed to purge bubbles from the ink supply path therefore increases in this type of inkjet printer. A specific amount of ink is also consumed and wasted each time ink is suctioned to purge bubbles from the ink supply path. This means that when ink is suctioned more frequently to purge bubbles from the ink supply path as happens with the inkjet printer taught in JP-A-2008-87217, the amount of ink wastefully consumed to purge bubbles from the ink supply path increases.

SUMMARY

A printer according to the present invention reduces the amount of ink wasted and consumed by purging bubbles from the ink supply path.

A first aspect of the invention is a printer including: a nozzle that ejects ink droplets; a bubble holding unit that is formed to an ink supply path through which ink supplied to the nozzle passes and holds bubbles in the ink supply path; a bubble detection unit that detects if the amount of bubbles in the bubble holding unit reaches a specific level; and a bubble discharge unit that ejects bubbles from the bubble holding unit based on the detection result from the bubble detection unit; wherein at least two paths including a first path and a second path through which ink supplied to the nozzle flows are formed in parallel in the ink supply path, ink flows through both the first path and the second path when the bubble discharge unit purges bubbles from the bubble holding unit, and ink flows only through the first path when printing to a print medium.

A printer according to the invention has a bubble holding unit that collects bubbles in the ink supply path. Bubbles in the ink supply path can therefore collect in the bubble holding unit so that the bubbles do not flow to the nozzle.

A printer according to the invention also has a bubble detection unit that detects if the amount of bubbles in the bubble holding unit reaches a specific level, and a bubble discharge unit that ejects bubbles from the bubble holding unit based on the detection result from the bubble detection unit. The bubble discharge unit can therefore purge the bubbles when the amount of bubbles in the bubble holding unit reaches a certain level, and bubbles in the ink supply path that have accumulated in the bubble holding unit can be discharged at once in a single purging operation. The invention can therefore reduce the frequency of the operation used to purge bubbles from the ink supply path, and as a result can reduce the amount of ink wastefully consumed by purging bubbles from the ink supply path.

Further preferably, at least two paths including a first path and a second path through which ink supplied to the nozzle flows are formed in parallel in the ink supply path, ink flows through both the first path and the second path when the bubble discharge unit purges bubbles from the bubble holding unit, and ink flows only through the first path when printing to a print medium.

This configuration enables discharging bubbles collected in the bubble holding unit when the bubble discharge unit purges bubbles from the bubble holding unit, and can prevent bubbles in the bubble holding unit from flowing toward the nozzle when printing on a print medium.

In a printer according to another aspect of the invention, ink supply path is formed so that ink flows from bottom to top; and the bubble holding unit is disposed at the top of the ink supply path at a position higher than the outlet of the ink supply path.

This aspect of the invention can use the buoyancy of the bubbles to reliably collect the bubbles in the bubble holding unit so that the bubbles do not flow to the nozzle.

Further preferably in a printer according to another aspect of the invention, the second path includes a horizontal path that forms a top part of the ink supply path in which ink flows horizontally, and a cavity that is recessed down and is formed in at least part of a bottom wall that defines the bottom of the horizontal path; and the bubble holding unit is rendered by the horizontal path and the cavity.

This configuration enables increasing the capacity of the bubble holding unit and enables increasing the amount of bubbles that can be collected in the bubble holding unit. The frequency of the operation used to purge bubbles from the ink supply path can therefore be further reduced.

Further preferably in a printer according to another aspect of the invention, the bubble detection unit includes a prism, a light-emitting device that emits light toward the prism, and a photodetector that senses light emitted from the light-emitting device and reflected by the prism; the prism is disposed inside the bubble holding unit; and a reflection face of the prism passes light from the light-emitting device when ink is in contact with the back of the reflection face, and reflects light from the light-emitting device when a bubble is in contact with the back of the reflection face.

Other objects and attainments together with a fuller understanding of the invention will become apparent and appreciated by referring to the following description and claims taken in conjunction with the accompanying drawings.

DESCRIPTION OF EMBODIMENTS

A check processing device 1 according to a preferred embodiment of the present invention is described below with reference to the accompanying figures.

General Configuration of a Check Processing Device

Figure 1:
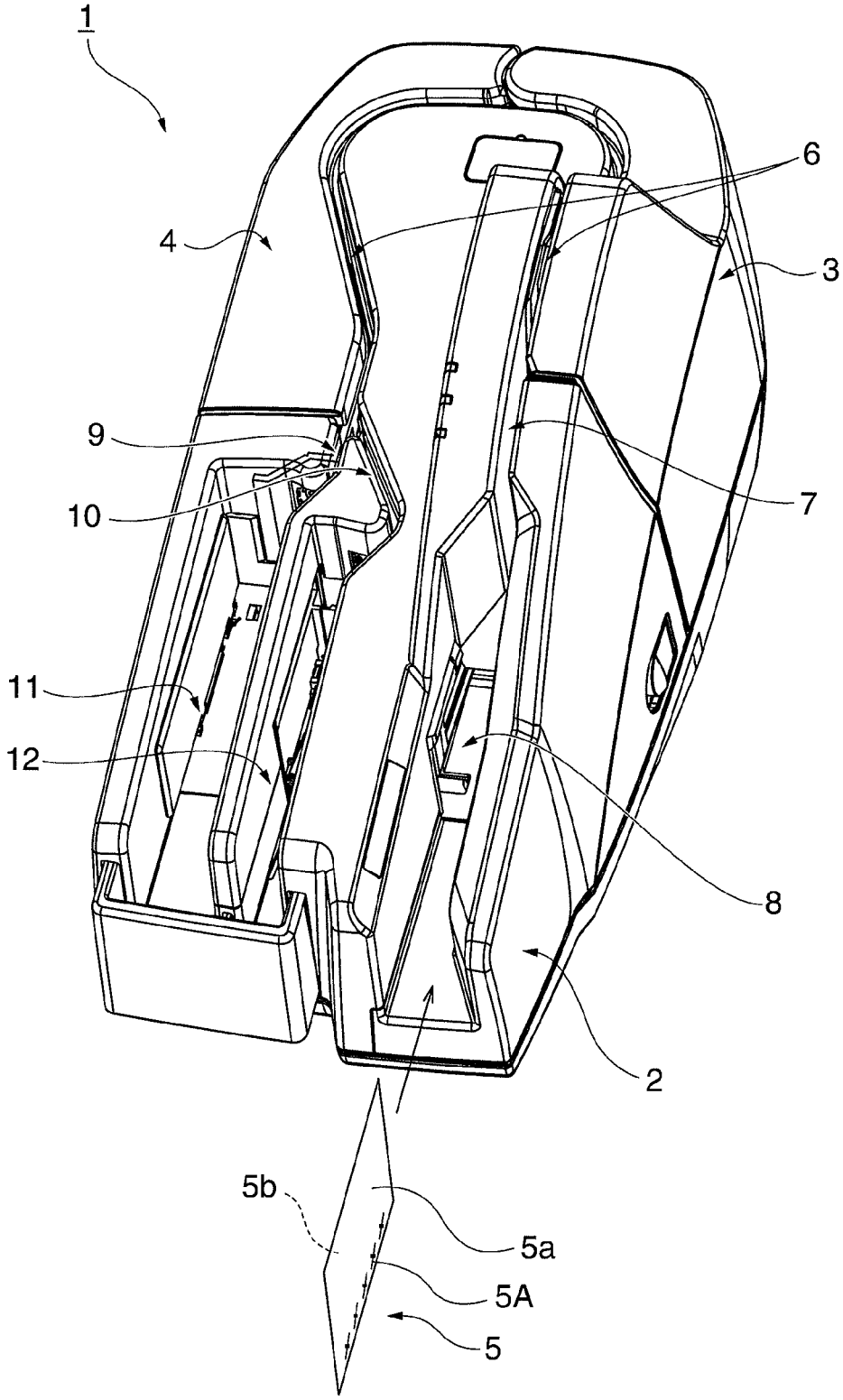
FIG. 1 is an external oblique view of a check processing device according to a preferred embodiment of the invention.
Figure 2:
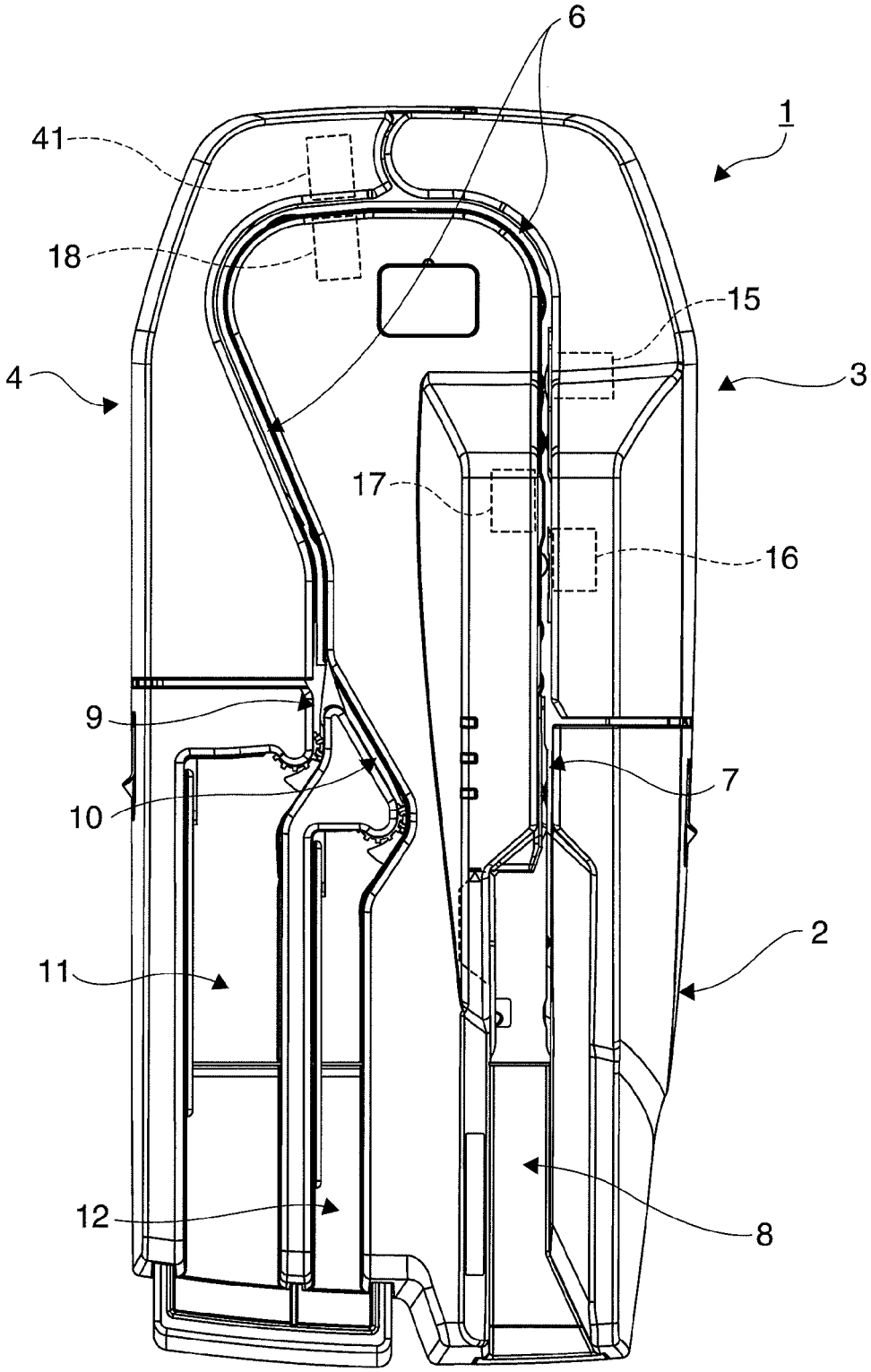
FIG. 2 is a plan view of the check processing device.

FIG. 1 is an oblique view of a check processing device 1 according to this embodiment of the invention. FIG. 2 is a plan view of the check processing device 1.

The check processing device 1 has a main case 2 and left and right access covers 3 and 4. A check conveyance path 6 for conveying the checks 5 is formed between the main case 2 and the access covers 3 and 4. The check conveyance path 6 in this embodiment of the invention is a narrow vertical channel that travels in a substantially U-shaped configuration when seen from above. The upstream end of the check conveyance path 6 in the check conveyance direction communicates with a check supply unit 8 rendered as a wide vertical channel through a check infeed channel 7 rendered as a narrow vertical channel. The downstream end of the check conveyance path 6 is connected through left and right diversion paths 9, 10, which are narrow vertical channels that split left and right, to first and second check discharge units 11 and 12, which are wide vertical channels on the left and right sides.

A MICR line 5A is printed along the bottom part of the front 5*a* of the check 5. Also included on the check front 5*a* against a background of a specific pattern are the check amount, payer, check number, and signature. An endorsement line is also provided on the back 5*b* side of the check 5. The checks 5 are loaded in the check supply unit 8 with the ends, tops, and bottoms of the checks aligned. The checks 5 are also inserted to the check supply unit 8 so that the fronts 5*a* face the outside of the U-shaped check conveyance path 6.

A plurality of conveyance roller pairs for conveying checks 5 through the check conveyance path 6 are disposed to the check conveyance path 6. Also disposed to the check conveyance path 6 as shown in FIG. 2 are a magnetic head 15 for reading the MICR line 5A, an image scanner 16 for imaging the front of checks 5, an image scanner 17 for imaging the back of checks 5, and a printhead 18 for printing on the back 5*b* of checks 5 conveyed through the check conveyance path 6.

While a check 5 fed from the check supply unit 8 through the check infeed channel 7 is conveyed through the check conveyance path 6, the MICR line 5A printed on the front 5*a*, and images of the check front and back, are read, and the check 5 is then ejected into the first check discharge unit 11 or second check discharge unit 12. The check processing device 1 also prints on the back 5*b* of the check 5 as needed.

Configuration of the Printhead and Surroundings

Figure 4:
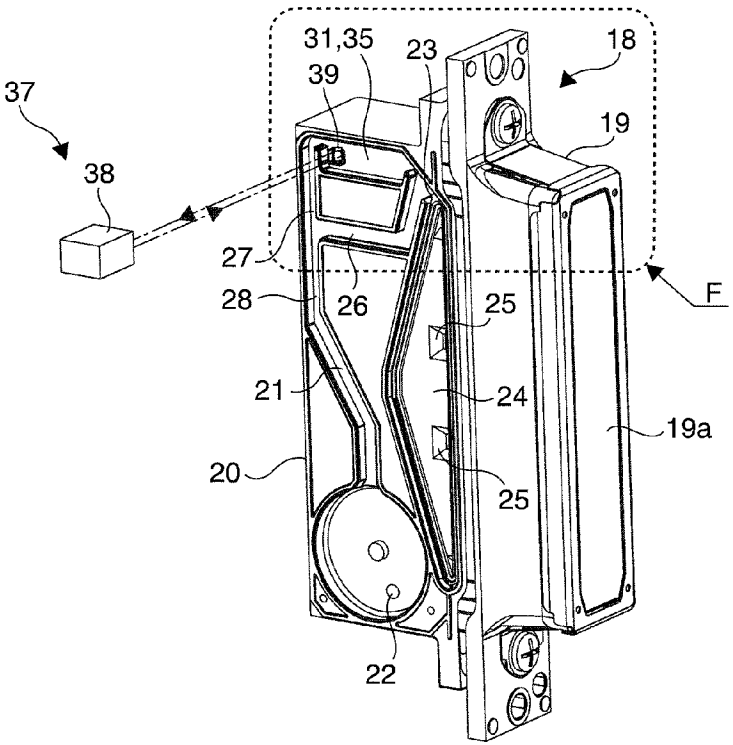
FIG. 4 is an oblique view showing the area around the printhead from the upstream side in the check conveyance direction.
Figure 3:
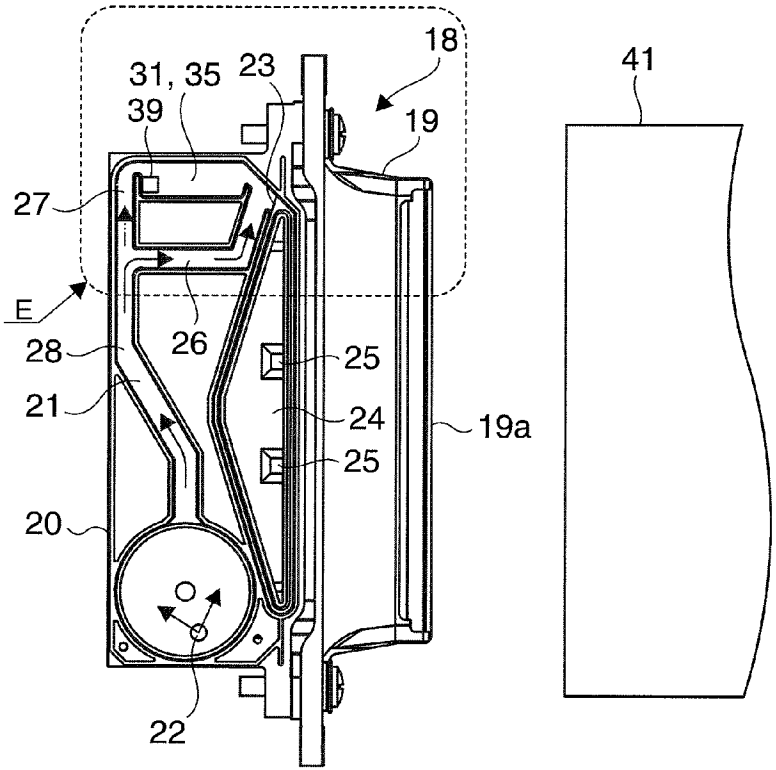
FIG. 3 is a side view showing the area around the printhead from the upstream side in the check conveyance direction.
Figure 5:
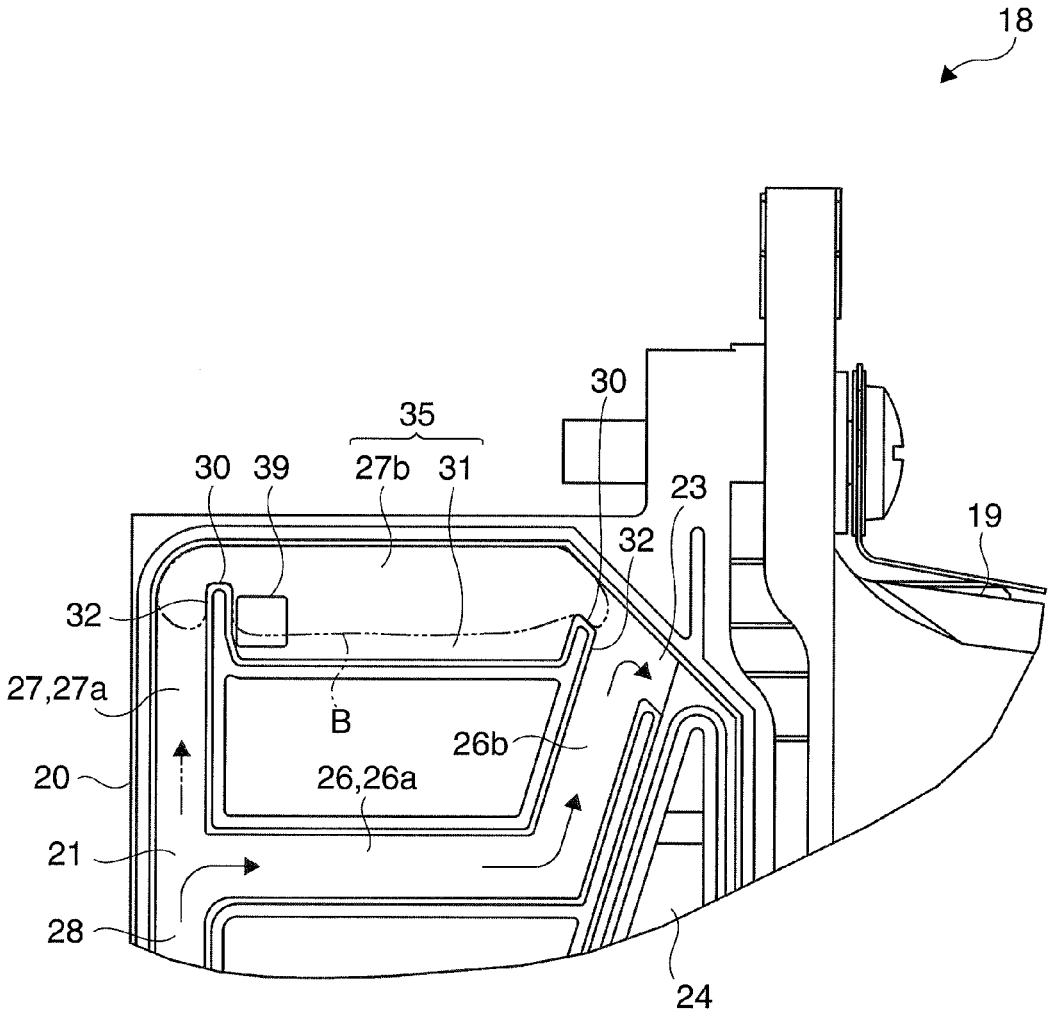
FIG. 5 is an enlarged view of part E in FIG. 3.
Figure 6:
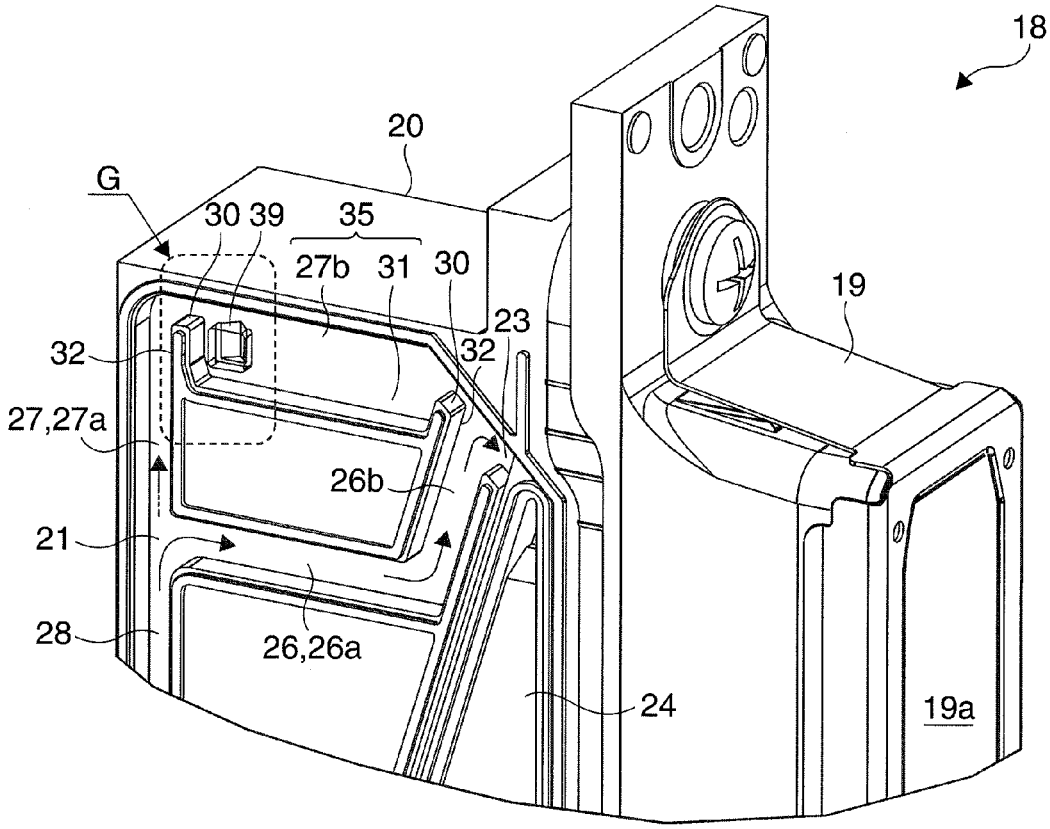
FIG. 6 is an enlarged view of part F in FIG. 4.
Figure 7:
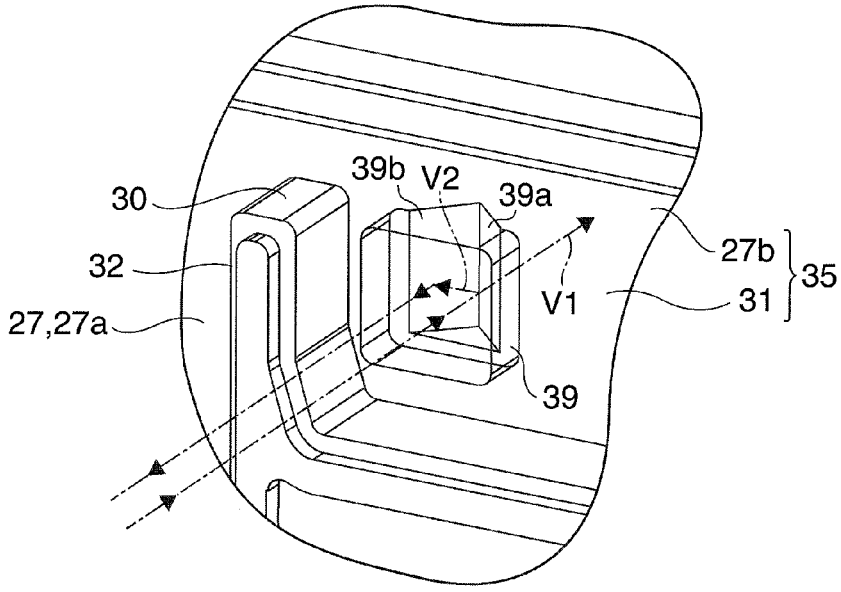
FIG. 7 is an enlarged view of part G in FIG. 6.

FIG. 3 is a side view showing the printhead 18 and surroundings from the upstream side in the check conveyance direction. FIG. 4 is an oblique view showing the printhead 18 and surroundings from the upstream side in the check conveyance direction. FIG. 5 is an enlarged view of part E in FIG. 3. FIG. 6 is an enlarged view of part F in FIG. 4. FIG. 7 is an enlarged view of part G in FIG. 6.

The printhead 18 is located on the inside of the U-shaped check conveyance path 6. The printhead 18 includes a main head unit 19. The main head unit 19 has a nozzle face 19*a* in which a plurality of nozzles for ejecting ink droplets is disposed. The nozzle face 19*a* is disposed vertically, and the printhead 18 discharges ink droplets horizontally. Ink chambers that communicate with the nozzles are formed inside the main head unit 19. A plurality of piezoelectric devices are also disposed inside the main head unit 19, and when a piezoelectric device is driven, the volume of the corresponding ink chamber changes and ink droplets are ejected from the associated nozzle.

A path forming member 20 is affixed to the opposite side of the main head unit 19 as the nozzle face 19*a*.

An ink supply path 21 through which ink supplied to the nozzles from the ink chamber passes is formed in the path forming member 20. The inlet 22 to the ink supply path 21 is formed at the downstream end of the path forming member 20, and the outlet 23 of the ink supply path 21 is formed at the upstream end of the path forming member 20. The ink supply path 21 is thus formed so that ink passes from the bottom to the top.

An ink cartridge is connected to the inlet 22 through a tube, for example. Ink supplied from the ink cartridge passes through the inlet 22 from the downstream side of the path forming member 20 in the check conveyance direction (the side from the back side of the page in FIG. 3) to the upstream side of the path forming member 20 in the check conveyance direction (the side on the front of the page in FIG. 3).

The outlet 23 is formed at the boundary between the ink supply unit 24 and the ink supply path 21 formed in the path forming member 20. A filter for removing foreign matter is disposed in the ink supply unit 24, and after passing through this filter ink flowing from the outlet 23 passes through a plurality of ink supply ports 25 formed in the ink supply unit 24 into the main head unit 19.

The ink supply path 21 is formed by a channel in the path forming member 20 that is recessed from the upstream side in the check conveyance direction to the downstream side in the check conveyance direction, and a transparent plastic film that is affixed to the upstream side surface of the path forming member 20 in the check conveyance direction. The upstream side of the ink supply path 21 is composed of two channels, a first channel 26 and a second channel 27, through which ink supplied to the main head unit 19 can pass. The first channel 26 and second channel 27 are parallel channels, diverge at the top end of a common channel 28 part of the ink supply path 21, and merge again before the outlet 23.

The first channel 26 includes a horizontal path 26*a* in which ink flows horizontally, and an inclined path 26*b* in which ink flows upward at an angle. One end of the horizontal path 26*a* is connected to the top end of the common channel 28, and the other end of the horizontal path 26*a* is connected to the bottom end of the inclined path 26*b*. The top end of the inclined path 26*b* merges with the second channel 27 before the outlet 23.

The second channel 27 includes a vertical path 27*a* in which ink flows upward, and a horizontal path 27*b* in which ink flows horizontally. The bottom end of the vertical path 27*a* is connected to the top end of the common channel 28, and the top end of the vertical path 27*a* connects to one end of the horizontal path 27*b*. The other end of the horizontal path 27*b* merges with the first channel 26 before the outlet 23.

The bottom wall 30 that defines the bottom of the horizontal path 27*b* also forms a downwardly recessed cavity 31. This cavity 31 is shaped like a bathtub and occupies almost all of the bottom wall 30. Because natural buoyancy causes bubbles to rise inside the ink supply path 21, bubbles inside the ink supply path 21 collect inside the horizontal path 27*b* and cavity 31 forming the top part of the ink supply path 21. In this embodiment of the invention the horizontal path 27*b* and cavity 31 disposed at the top end of the ink supply path 21 render a bubble collection unit 35 in which bubbles in the ink supply path 21 are held. The bubble collection unit 35 is located higher than the outlet 23. Note that bubbles that cannot pass the filter disposed in the ink supply unit 24 and flow back into the ink supply path 21 also collect in the bubble collection unit 35.

The check processing device 1 also has a bubble detection unit 37 that detects if the amount of bubbles B (FIG. 5) inside the bubble collection unit 35 has reached a specified level. As shown in FIG. 4, the bubble detection unit 37 includes a reflective photosensor 38 and a prism 39. The photosensor 38 includes a light-emitting device that emits light toward the prism 39, and a photodetector that senses light emitted by the light-emitting device and reflected by the prism 39. The prism 39 is fixed inside the cavity 31. More specifically, the prism 39 is fixed inside the cavity 31 near the side wall 32 located at the boundary between the vertical path 27*a* and the cavity 31.

A first reflection face 39*a* of the prism 39 passes light from the light-emitting device as indicated by arrow V1 in FIG. 7 when there are few bubbles B in the bubble collection unit 35 and ink is in contact with the back side of the first reflection face 39*a*. However, when the amount of bubbles B inside the bubble collection unit 35 reaches a specific level and bubbles B are in contact with the back of the first reflection face 39*a* as indicated by the double-dot dash line in FIG. 5, the first reflection face 39*a* reflects light from the light-emitting device to a second reflection face 39*b* as indicated by arrow V2 in FIG. 7.

The second reflection face 39*b* reflects the reflection from the first reflection face 39*a* to the photodetector. Therefore, when light emitted from the light-emitting device is sensed by the photodetector, the amount of bubbles B inside the bubble collection unit 35 is detected to have reached the specific level. More specifically, when light emitted from the light-emitting device is sensed by the photodetector, the bubble collection unit 35 is detected to be nearly filled with bubbles B.

The capacity of the bubble collection unit 35 is set so that, for example, the bubble collection unit 35 can hold all of the bubbles B expected to accumulate in the top of the ink supply path 21 during a period of approximately four to six months in the worst-case scenario starting from a state in which there are no bubbles B in the bubble collection unit 35.

A cleaning cap (bubble purging unit) 41 that covers the nozzle face 19*a* is also disposed opposite the nozzle face 19*a* of the printhead 18. The cleaning cap 41 is disposed on the outside of the U-shaped check conveyance path 6 at a position opposite the nozzle face 19*a* with the check conveyance path 6 therebetween.

The cleaning cap 41 is connected to a moving mechanism that moves the cleaning cap 41 in the direction in which the nozzle face 19*a* and cleaning cap 41 move closer together, and in the direction in which the nozzle face 19*a* and cleaning cap 41 move apart. A suction pump is also connected to the cleaning cap 41. When cleaning the printhead 18, the cleaning cap 41 covers the nozzle face 19*a* and suction is applied to the nozzles of the nozzle face 19*a*.

When the bubble detection unit 37 detects that the amount of bubbles B inside the bubble collection unit 35 has reached the specified level, the check processing device 1 cleans the printhead 18 by means of the cleaning cap 41. The speed of the ink flowing through the ink supply path 21 during cleaning by means of the cleaning cap 41 is greater than the speed of the ink flowing the ink supply path 21 when printing on a check 5 by means of the printhead 18.

In this embodiment of the invention the width, length, and depth of the first channel 26 and second channel 27 are set so that pressure loss in the first channel 26 is greater than pressure loss in the second channel 27. zxq More specifically, the width, length, and depth of the first channel 26 and second channel 27 are set so that ink flows through the first channel 26 and second channel 27 when the speed of ink flowing through the ink supply path 21 is fast during the cleaning operation of the cleaning cap 41, but ink flows only through the first channel 26 when the speed of ink flowing through the ink supply path 21 is slow while printing on a check 5. More specifically, in this embodiment of the invention ink flows through both the first channel 26 and second channel 27 during the cleaning operation using the cleaning cap 41, and when printing on a check 5, ink flows only through the first channel 26 and does not flow through the second channel 27.

As a result, the bubbles B held in the bubble collection unit 35 flow through the bubble collection unit 35 and are purged from the bubble collection unit 35 during the cleaning operation using the cleaning cap 41. The bubbles purged from the bubble collection unit 35 pass through the filter disposed in the ink supply unit 24, and are discharged to the outside of the printhead 18 from the nozzles of the printhead 18. On the other hand, ink passing through the first channel 26 is supplied into the main head unit 19 when printing on a check 5, but any bubbles B that stop in the bubble collection unit 35 remain in the bubble collection unit 35.

Main Effect of the Invention

As described above, this embodiment of the invention has a bubble collection unit 35 formed inside the ink supply path 21 to collect and hold bubbles in the ink supply path 21. As a result, bubbles in the ink supply path 21 can be held inside the bubble collection unit 35 so that bubbles in the ink supply path 21 do not flow into the main head unit 19. In this embodiment of the invention the bubble collection unit 35 is formed at the top end of the ink supply path 21 and is located at a position higher than the outlet 23. As a result, bubbles can be reliably collected in the bubble collection unit 35 using the natural buoyancy of the bubbles so that the bubbles do not flow into the main head unit 19.

When the amount of bubbles B in the bubble collection unit 35 is detected by the bubble detection unit 37 to have reached a certain level, this embodiment of the invention cleans the printhead 18 using the cleaning cap 41 and discharges the bubbles B from the bubble collection unit 35. Bubbles in the ink supply path 21 held in the bubble collection unit 35 can therefore be discharged in a single purging operation. This embodiment of the invention can therefore reduce the frequency at which bubbles must be purged from the ink supply path 21, and as a result can reduce the amount of ink that is wastefully consumed to purge bubbles from the ink supply path 21.

More particularly, because the bubble collection unit 35 is formed by the horizontal path 27*b* and cavity 31, the capacity of the bubble collection unit 35 can be increased and the amount of bubbles B that can be stored in the bubble collection unit 35 can be increased when compared with a configuration in which the bubble collection unit 35 is formed by the horizontal path 27*b* alone. More bubbles can therefore be collected in the bubble collection unit 35 and discharged at once in a single purging operation, and the frequency at which bubbles must be purged from the ink supply path 21 can be reduced. This embodiment of the invention can therefore further reduce the amount of ink that is wastefully consumed to purge bubbles from the ink supply path 21.

When the amount of bubbles B in the bubble collection unit 35 is detected by the bubble detection unit 37 to have reached a certain level, this embodiment of the invention cleans the printhead 18 using the cleaning cap 41 and discharges the bubbles B from the bubble collection unit 35. As a result, bubbles exceeding the capacity of the bubble collection unit 35 can be prevented from passing through the filter in the ink supply unit 24 when printing a check 5 and flowing into the main head unit 19. This embodiment of the invention can therefore prevent dropped dots, faint printing, and other printing problems caused by bubbles in the ink supply path 21, and can maintain print quality.

Other Embodiments

The bubble detection unit 37 in the foregoing embodiment is rendered by a reflective photosensor 38 and a prism 39, but the bubble detection unit 37 can alternatively use a transmissive photodetector and prism 39, for example.

Further alternatively, the bubble detection unit 37 could be rendered using a pair of electrodes disposed to the bubble collection unit 35. In this configuration, whether the amount of bubbles B in the bubble collection unit 35 has reached the specific level can be detected by measuring change in electrical resistance between the pair of electrodes, or by measuring change in electrostatic capacitance between the pair of electrodes.

However, if the bubble detection unit 37 is rendered using a pair of electrodes, for example, noise from the electrodes could adversely affect driving the piezoelectric devices of the printhead 18, for example, and the bubble detection unit 37 is therefore preferably rendered using optical devices.

The cavity 31 is formed occupying the entire range of the bottom wall 30 in the embodiment described above, but the cavity 31 could be formed in only part of the bottom wall 30. Further alternatively, the bubble collection unit 35 could be formed using only the horizontal path 27*b* without forming a cavity 31 in the bottom wall 30.

The printhead 18 in this embodiment of the invention cannot move widthwise to the check 5 used as the print medium, but the printhead 18 could be mounted on a carriage so that it can move widthwise to the check 5. The printhead 18 is also disposed in the foregoing to eject ink droplets horizontally, but the printhead 18 could be disposed to eject ink downward.

A check processing device 1 is described as an example of a printer according to a preferred embodiment of the invention above, but the invention can also be applied to other types of inkjet printers that do not have a magnetic head 15 and image scanners 16, 17.

The bubble detection unit 37 is constructed using a reflective photosensor 38 and a prism 39 in the embodiment described above, but the amount of bubbles B in the bubble collection unit 35 could be determined to have reached the specific level using a timer instead of a bubble detection unit 37. In this case, the timer measures the time passed since the last ink ejection operation (printing process or cleaning process), and the amount of bubbles B in the bubble collection unit 35 is determined to have reached the specific level when the elapsed time is greater than or equal to a specified duration.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a nozzle that ejects ink droplets;

a bubble holding unit that is formed in an ink supply path through which ink supplied to the nozzle passes and holds bubbles in the ink supply path;

a bubble detection unit that detects a amount of bubbles in the bubble holding unit reaches a specific level; and a bubble discharge unit that discharges bubbles from the bubble holding unit based on the detection result from the bubble detection unit;

wherein at least two paths including a first path and a second path through which ink supplied to the nozzle are formed in parallel in the ink supply path, the ink flows through both the first path and the second path when the bubble discharge unit purges bubbles from the bubble holding unit, and the ink flows only through the first path when printing to a print medium.

2. The printer described in claim 1, wherein:

at least part of the second path is the bubble holding unit.

3. The printer described in claim 1, wherein:

the ink supply path is formed so that the ink flows from a bottom to a top; and the bubble holding unit is disposed at the top of the ink supply path at a position higher than an outlet of the ink supply path.

4. The printer described in claim 2, wherein:

the second path includes a horizontal path that forms a top part of the ink supply path in which ink flows horizontally, and a cavity that is recessed down and is formed in at least part of a bottom wall that defines the bottom of the horizontal path; and the bubble holding unit is rendered by the horizontal path and the cavity.

5. The printer described in claim 1, wherein:

the bubble detection unit includes a prism, a light-emitting device that emits light toward the prism, and a photodetector that senses light emitted from the light-emitting device and reflected by the prism;

the prism is disposed inside the bubble holding unit; and a reflection face of the prism passes light from the light-emitting device when ink is in contact with the back of the reflection face, and reflects light from the light-emitting device when a bubble is in contact with the back of the reflection face.

6. A printer comprising:

a nozzle that ejects ink droplets;

a bubble holding unit that is formed in an ink supply path through which ink supplied to the nozzle passes and holds bubbles in the ink supply path; and a bubble discharge unit that discharges bubbles from the bubble holding unit;

wherein at least two paths including a first path and a second path through which ink supplied to the nozzle are formed in parallel in the ink supply path, the ink flows through both the first path and the second path when the bubble discharge unit purges bubbles from the bubble holding unit, and the ink flows only through the first path when printing to a print medium.

7. The printer described in claim 6, further comprising:
a timer that calculates an amount of the bubbles held in the bubble holding unit.

* * * * *